US006935406B2

(12) United States Patent
Flemings et al.

(10) Patent No.: US 6,935,406 B2
(45) Date of Patent: Aug. 30, 2005

(54) HIGH PRESSURE CENTRIFUGAL CASTING OF COMPOSITES

(75) Inventors: Merton C. Flemings, Cambridge, MA (US); Jessada Wannasin, Cambridge, MA (US); Hoe Phong Tham, Singapore (SG)

(73) Assignee: Massachusetts Institute of Technology, Cambridge, MA (US)

( * ) Notice: Subject to any disclaimer, the term of this patent is extended or adjusted under 35 U.S.C. 154(b) by 13 days.

(21) Appl. No.: 10/360,405

(22) Filed: Feb. 6, 2003

(65) Prior Publication Data

US 2004/0154777 A1 Aug. 12, 2004

(51) Int. Cl.[7] ..... B22D 13/00; B22D 13/12; B22D 37/00

(52) U.S. Cl. ..... 164/114; 164/133; 164/290

(58) Field of Search ..... 164/289, 290, 164/133–136, 114–116, 189, 190

(56) References Cited

U.S. PATENT DOCUMENTS 2,011,007 A * 8/1935 May ..... 29/890.127
3,627,023 A * 12/1971 Clark et al. ..... 164/264
4,063,863 A * 12/1977 Hilmoe ..... 425/425
4,294,792 A * 10/1981 Arons et al. ..... 264/311
4,424,853 A * 1/1984 Khandros et al. ..... 164/57.1
5,002,115 A * 3/1991 Noordegraaf et al. ..... 164/97
5,299,619 A * 4/1994 Chandley et al. ..... 164/53
2004/0026063 A1 * 2/2004 Cser ..... 164/114

FOREIGN PATENT DOCUMENTS

DE 35 46 188 * 7/1987
JP 57-177874 * 11/1982

OTHER PUBLICATIONS

Taha, et al., "Metal–matrix composites fabricated by pressure–assisted infiltration of loose ceramic poweder," *J. Mat. Proc. Tech.* 73:139–146 (1998).

* cited by examiner

*Primary Examiner*—Kuang Y. Lin
(74) *Attorney, Agent, or Firm*—Choate, Hall & Stewart LLP

(57) ABSTRACT

A system and method for centrifugal casting of composites, especially metal-matrix composites. According to the system and method, a porous preform is infiltrated with matrix material using a centrifugal force to pressurize the matrix material against the preform. The pressure head of the matrix material is maintained at an approximately constant level throughout infiltration.

22 Claims, 7 Drawing Sheets

HIGH PRESSURE CENTRIFUGAL CASTING OF COMPOSITES

FIELD OF THE INVENTION

This invention pertains to methods of forming composite materials by centrifugal casting and composites so formed, particularly metal-matrix composites formed by centrifugal casting.

BACKGROUND OF THE INVENTION

Centrifugal force has long been used as an aid in the casting of materials, especially metals. In its earliest forms, centrifugal casting was used simply to ensure that the mold was completely filled with liquid metal. More recently, centrifugal casting has been used to form composite materials. In particular, it has been used to infiltrate ceramic reinforcements with a liquid metal. For many popular metal/ceramic systems (e.g., metals such as aluminum, zinc, magnesium, titanium, iron (steel), copper, nickel, superalloys, and alloys based on these metals, combined with reinforcements such as carbon (e.g., as graphite), silicon carbide, alumina, silica, titanium carbide, titanium boride, and mixtures thereof), the liquid metal does not "wet" the ceramic, so some force must be used to introduce the metal into a reinforcement preform. For example, see U.S. Pat. No. 5,002,115, incorporated by reference herein, which describes the use of a spinning mold to force molten aluminum or zinc into a silicon carbide preform.

Taha, et al., "Metal-matrix composites fabricated by pressure-assisted infiltration of loose ceramic powder," *J. Mat. Proc. Tech.* 73:139–146 (1998) compares centrifugal casting and squeeze casting of Al-12Si-2Mg/$Al_2O_3$ composites, and finds significant advantages to centrifugal casting. In particular, the pressure necessary to infiltrate the preform in centrifugal casting was found to be significantly lower than the required pressure for squeeze casting.

SUMMARY OF THE INVENTION

In one aspect, the invention comprises a centrifugal casting system. The system includes an elongated mold cavity with a mold section and a runner section, where the runner section has a central axis, a porous preform in the mold section, means for rotating the mold cavity about a rotation axis oblique to the central axis, and a reservoir for introducing molten matrix material into the mold cavity at a selected head pressure. The pressure at the mold section remains approximately constant during and after filling of the mold cavity and infiltration of the porous preform.

The reservoir may be located at the rotation axis, and may be an extension of the mold cavity, with the same or greater cross-sectional area than the mold cavity, or it may comprise rapid-filling means for introducing additional material to maintain the head pressure. The system may also include a gate to prevent introduction of molten matrix material into the mold section until a predetermined time or pressure is reached. The gate include be a melting, dissolving, or reacting gate, or it may include a valve. It may also be triggered to open by the rotation of the mold cavity, such as a gate which comprises a porous plug having a characteristic infiltration pressure, so that molten material flows through the plug once the characteristic pressure is reached. The molten matrix material may be a metal (e.g., aluminum, zinc, magnesium, titanium, iron, copper, nickel, superalloys, or alloys based on any of these), a semisolid, a slurry, or a reactive fluid. The porous preform may comprise a ceramic (e.g., carbon, silicon carbide, alumina, silica, titanium carbide, or titanium boride). The system may include an additional elongated mold cavity, where the rotation means rotates both mold cavities about the same rotation axis. The system may be used for reactive infiltration, where the molten matrix material reacts with the porous preform as it enters the mold section.

In another aspect, the invention comprises a microcasting system. The system includes an elongated mold cavity with a mold section and a runner section, where the runner section has a central axis, a micron-scale or submicron mold in the mold section, means for rotating the mold cavity about a rotation axis oblique to the central axis, and a reservoir for introducing molten matrix material into the mold cavity at a selected head pressure. The pressure at the mold section remains approximately constant during and after filling of the mold cavity, including the micron-scale or submicron mold. The system may also include a gate to prevent introduction of molten matrix material into the mold section until a predetermined time or pressure is reached. The gate include be a melting, dissolving, or reacting gate, or it may include a valve. It may also be triggered to open by the rotation of the mold cavity, such as a gate which comprises a porous plug having a characteristic infiltration pressure, so that molten material flows through the plug once the characteristic pressure is reached.

In yet another aspect, the invention comprises a method of forming a composite. The method comprises introducing a porous preform comprising a reinforcing material into a centrifugal caster. The centrifugal caster includes an elongated mold cavity with a mold section and a runner section, where the runner section has a central axis, and a reservoir for introducing molten matrix material into the mold cavity. The preform is placed in the mold section of the mold cavity. Sufficient molten matrix material to infiltrate the preform and fill the mold cavity is introduced into the reservoir, and the mold cavity is rotated about the rotation axis at a speed sufficient to accelerate the molten matrix material to create a pressure head in excess of the characteristic threshold infiltration pressure. The preform is infiltrated with molten matrix material, while the pressure head is maintained at an approximately constant level throughout infiltration. The caster may further comprise a gate positioned between the reservoir and the mold section, which is opened after rotation of the mold cavity commences. The reservoir and/or the mold cavity may be heated.

BRIEF DESCRIPTION OF THE DRAWING

The invention is described with reference to the several figures of the drawing, in which.

DETAILED DESCRIPTION

The present inventors have found that the centrifugal casting process for composites can be substantially improved by providing an excess of matrix material (generally but not necessarily molten metal), and by operating at a pressure substantially in excess of the threshold pressure for infiltration.

As discussed above, Taha et al. have shown that the infiltration pressure using a centrifuigal caster is significantly lower than the infiltration pressure for squeeze casting using the same metal-reinforcement system. In addition, they found that infiltration length was independent of acting pressure once the threshold infiltration pressure was exceeded, suggesting that it was unnecessary to spin at a speed faster than that needed to achieve the threshold pressure. Further, since full infiltration was achieved whenever the threshold pressure was exceeded throughout infiltration, they found that as long as a characteristic minimum length of molten metal was maintained, no additional excess metal needed to be provided.

In contrast, the present inventors have found that using a long runner that is filled with more molten metal results in better composite characteristics, including more complete infiltration (less porosity and shrinkage). Further improvements can be made by using a reservoir (such as a riser) so that a constant pressure head can be maintained during infiltration.

In addition, the inventors have developed a centrifugal casting gating system that allows for better control of the timing of infiltration and reduction of degradation of the preform by extended contact with hot metal. By placing a gate between the runner and the mold cavity, flow of liquid metal into the preform is restricted until a desired pressure head has been achieved.

Figure 1:
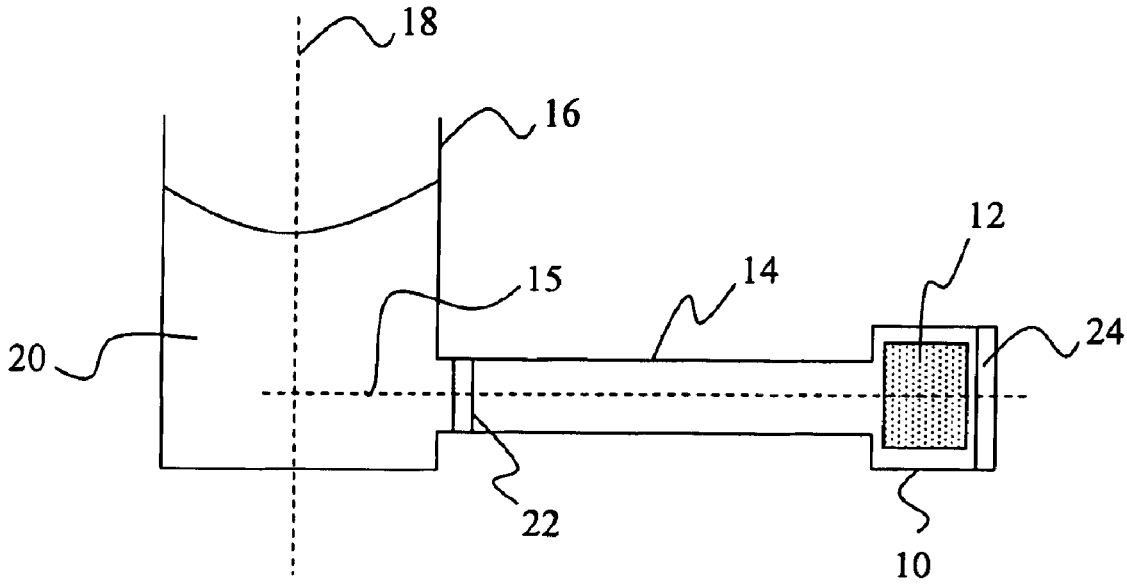
FIG. 1 is a centrifugal casting system according to one embodiment of the invention.
Figure 2:
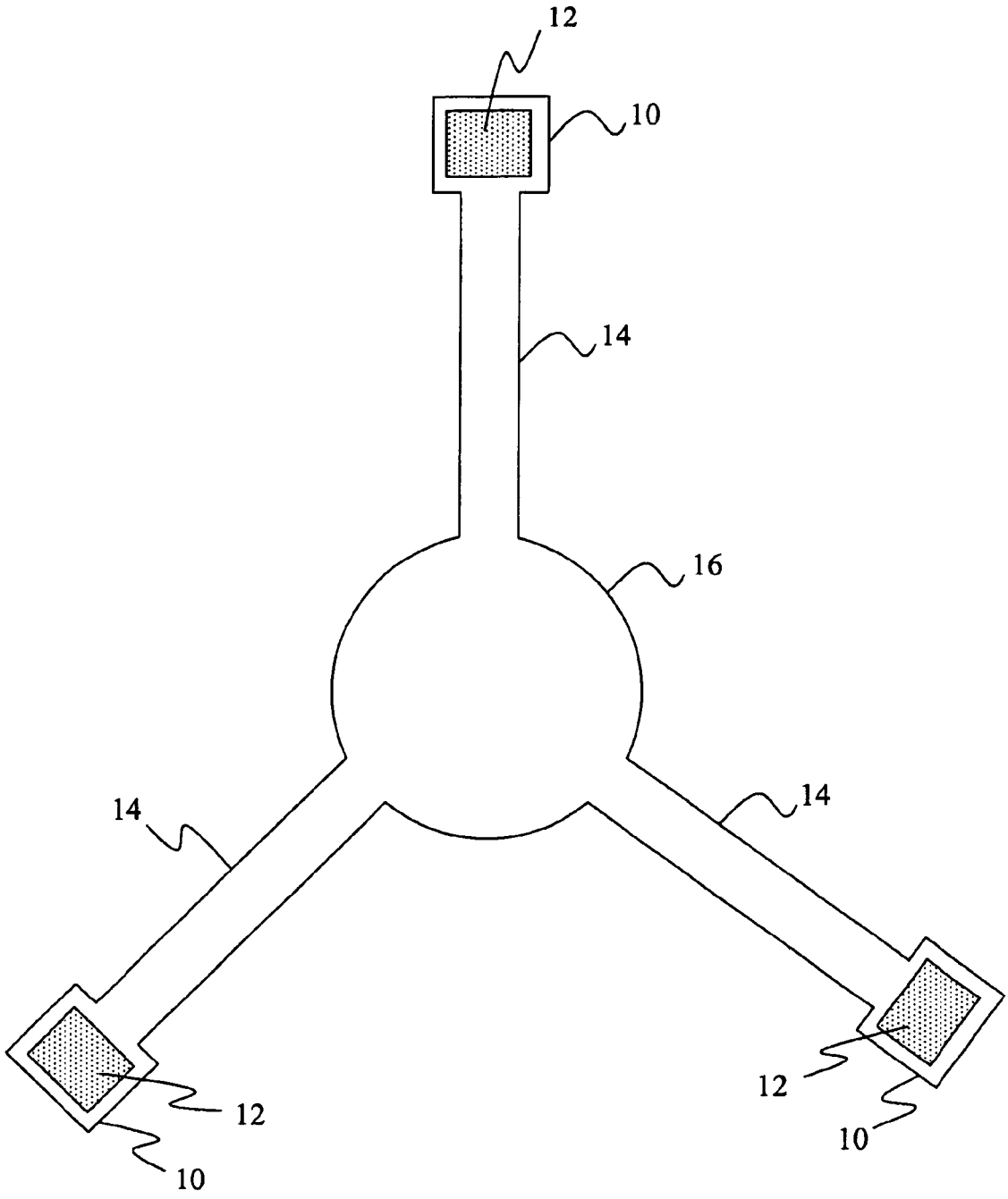
FIG. 2 is a centrifugal casting system including multiple molds arranged in a hub-and-spoke configuration.

FIG. 1 shows a centrifugal caster according to one embodiment of the invention. The caster includes a mold cavity 10 in which a reinforcing preform 12 has been placed, an elongated runner 14 having a central axis 15, and a reservoir 16. The caster can be spun about vertical axis 18, which is oblique to runner axis 15. Means (not shown) may be provided to balance the spin of the caster to facilitate the spin—for example, a counterbalancing weight may be used, or a second runner and mold cavity may be provided opposite to those shown. (If desired, any number of runners and mold cavities may be used, either sharing a common reservoir or each served by a separate reservoir. These runners and mold cavities may be distributed about the caster in a spoke-and-hub arrangement, with the reservoir(s) placed at the hub of the wheel, as shown in FIG. 2).

In operation, reservoir 16 and optionally runner 14 are filled with a molten metal 20. The caster is spun about vertical axis 18, creating a centrifugal force tending to urge the molten metal 20 towards the mold cavity. (This force will also tend to cause the metal surface to assume the curved shape shown in FIG. 1). Access of the metal to the mold cavity 10 may optionally be controlled by a gate 22, further discussed below. The pressure of the molten metal at the entrance to the mold cavity is a function of the length of the runner 14, the speed of rotation, and the height of the liquid metal 20 in the reservoir 16. Preferably, sufficient molten metal 20 is placed in the reservoir 16 that the liquid level remains relatively high even after full infiltration (i.e., there is more molten metal than necessary to fully infiltrate the preform and to fill the runner). The mold cavity and/or reservoir may optionally be heated before or during infiltration, or the matrix material may be separately melted and poured into the reservoir for molding without additional heating.

In some embodiments of the invention, the caster comprises one or more gates 22, which may be placed anywhere between the reservoir 16 and the mold cavity 10. These gates may be used to control the timing of the introduction of molten metal into the mold cavity. For example, it may be desirable to spin up the mold before beginning infiltration, in order to prevent any clogging due to premature solidification of the metal before full pressure is applied, and to prevent degradation of the preform due to extended contact with hot metal. The gate may be used to "hold back" the molten metal until full rotation speed has been achieved for rapid infiltration.

A gate may also be particularly useful for performing reactive infiltration, where the length of time that the metal contacts the preform is important. By allowing the caster to fully "spin up" before the metal is allowed to reach the preform, infiltration can be more rapid, allowing a more uniform reaction across the finished composite. Even in cases where the matrix material wets the preform, so no capillary force needs to be overcome for infiltration, this rapid infiltration may be particularly useful for in-situ reactive processing. However, reactive infiltration may also be performed according to the invention without a gate, as long as any early reaction does not "choke off" infiltration into the remainder of the preform.

The gate may be a simple valve arrangement that can be opened to admit the molten metal, or the valve may be responsive to the introduction of the metal or to the spin of the caster. For example, a thin layer of a material with a higher melting point than the infiltrating metal may be interposed in the runner, and then heated to its melting point (e.g., by an external heater, or by resistance or induction heating) to admit the molten metal through the runner. Alternatively, a material with a lower melting point could be heated by the action of the molten metal itself in order to open the gate, or a frangible membrane could be designed to break when a full pressure head is established (at a predetermined spin rate). A "disappearing" gate may also be formed of a material that will dissolve in the molten metal, or one that reacts with the molten metal.

The existence of a characteristic infiltration pressure for a porous preform may also be used to create a pressure-responsive gate. In this embodiment, a porous plug is placed in the runner. Capillary pressure prevents metal from entering the plug until its infiltration pressure is achieved, at which time the metal flows through the plug to reach the preform. Other suitable gate mechanisms will also be readily apparent to those with skill in the art.

In order to ensure complete infiltration, it may be desirable to provide a venting system 24 to allow any trapped air to be evacuated from the system (to avoid the formation of bubbles at the back of the mold). Alternatively, infiltration may be carried out under vacuum to minimize this potential problem.

Figure 3A:
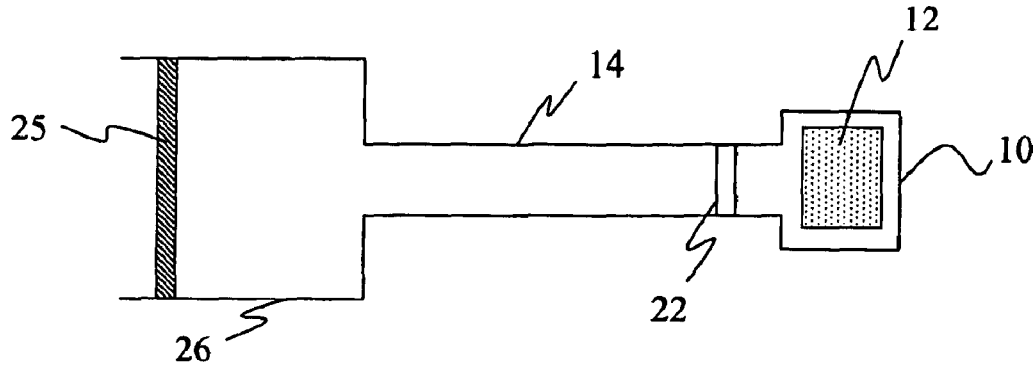
FIGS. 3*a*, 3*b*, and 3*c* show alternate embodiments of the reservoir and mold cavity.
Figure 3B:
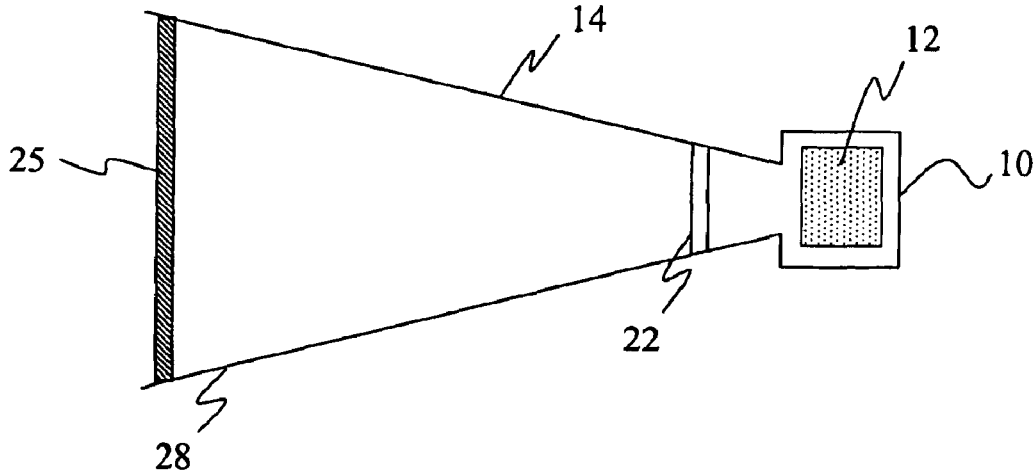
Figure 3C:
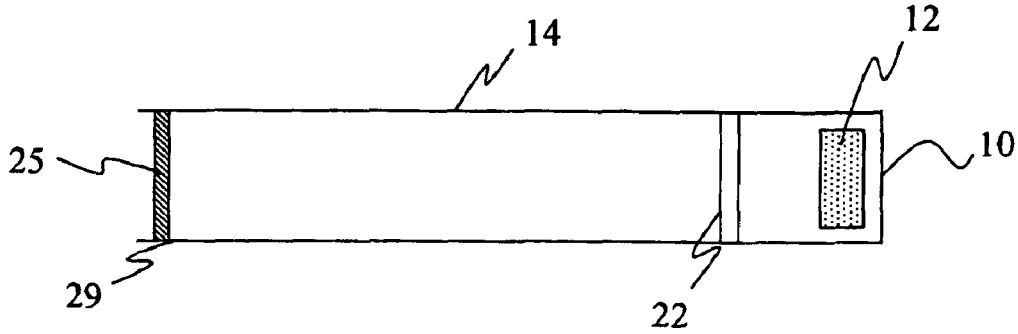

The "reservoir" according to the invention need not be the simple container 16 shown in FIG. 1. It merely must have some arrangement that allows the pressure head to be maintained at an approximately constant level. For example, the reservoir may be a widened section 26, 28 continuous with the runner, as shown in FIGS. 3*a* and 3*b*. Alternatively, the reservoir 29 need not even be wider than the mold cavity, as shown in FIG. 3*c*, as long as the pressure remains nearly constant during infiltration. For each of these examples, the pressure drop during infiltration is relatively small, because the metal "front" 25 moves only a small distance during infiltration, due to the large cross-sectional area of the reservoir as compared to the mold. Alternatively, the "reservoir" may be an external rapid-filling system which is designed to maintain sufficient pressure during casting.

In other embodiments, the invention may also be used for microcasting. In microcasting, parts with micron-scale features (on the order of 1–1000 μm) are formed by traditional casting processes. If the metal (or other material) to be cast does not wet the mold, it may be very difficult to completely fill the mold. In such cases, centrifugal pressure may be used as discussed above to completely fill the mold.

Figure 4:
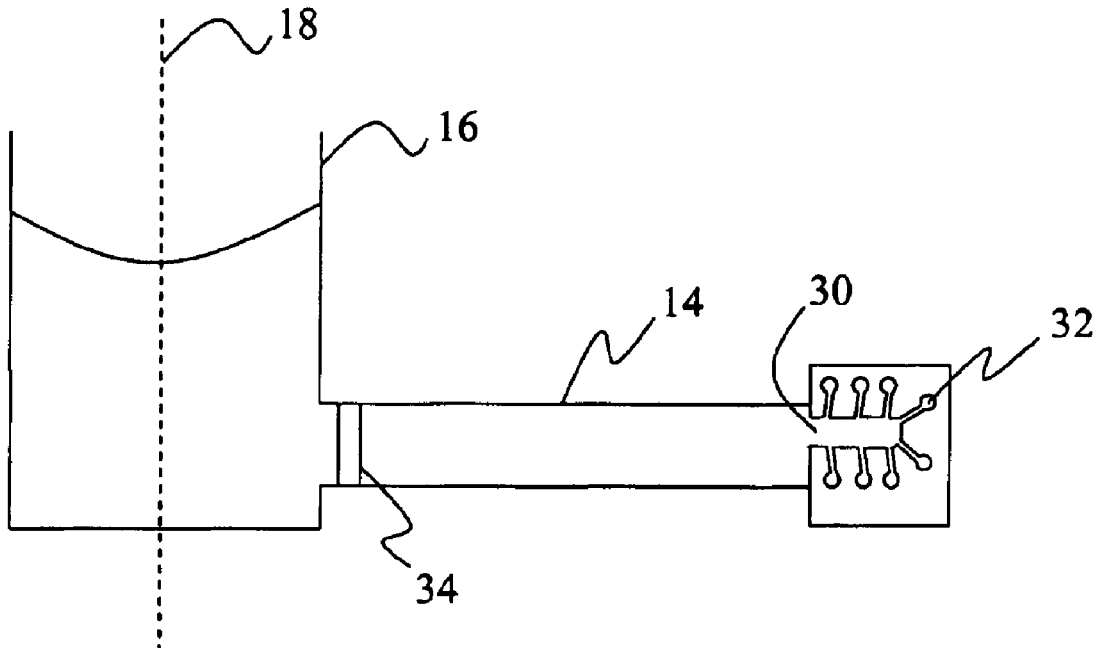
FIG. 4 is a centrifugal microcasting system.

FIG. 4 shows a microcasting system according to the invention. The configuration of the system is essentially similar to that used for infiltration of composites as shown in FIG. 1, but the preform is replaced with a tortuous mold tree 30 including many micron-scale parts 32. Again, the mold and runner are rotated to create a centrifugal force, and an optional gate 34 controls access of the molten metal to the mold. By using a reservoir 16, pressure is maintained throughout infiltration to completely fill the mold.

EXAMPLES

A centrifugal casting system according to the invention has been used to cast metal/alumina composites. An alloy of Sn-15% Pb was used to infiltrate a preform having 35–40% volume fraction of alumina powder (Micropolish II deagglomerated alpha alumina, obtained from Buehler, Ltd., of Lake Bluff, Ill.). Powders having average particle sizes of 1 μm and 0.3 μm were used.

Figure 5:
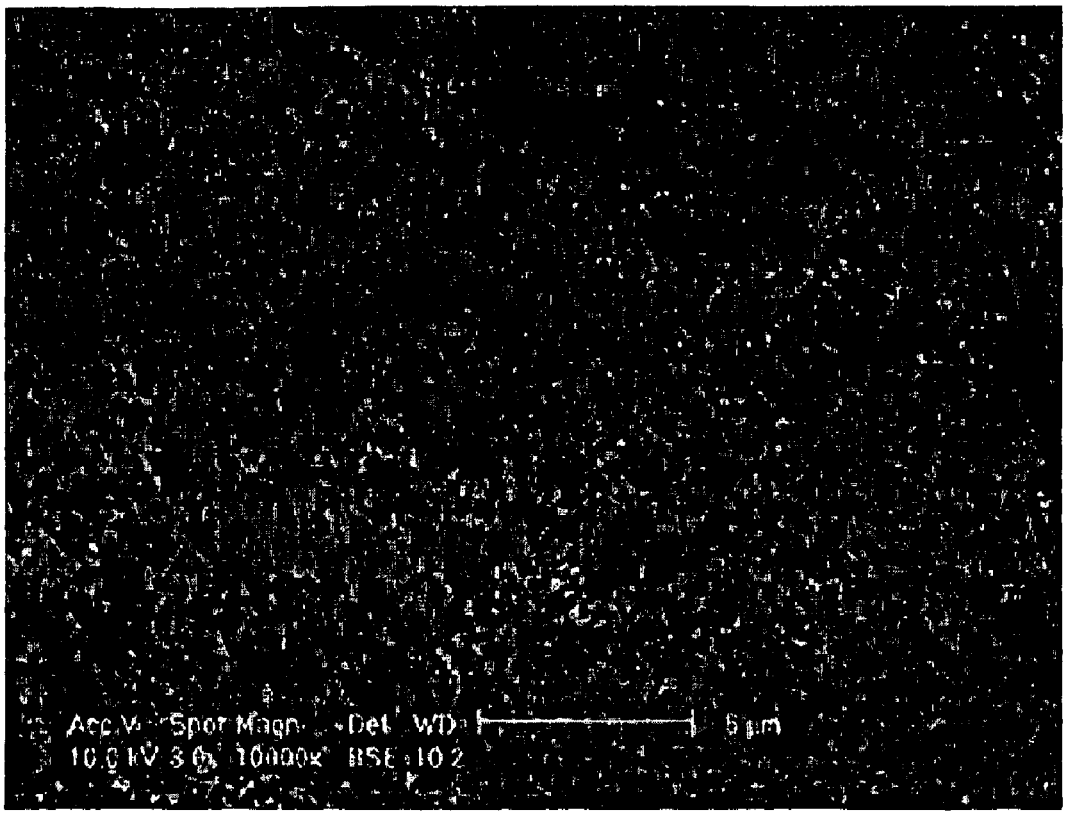
FIGS. 5, 6, and 7 are micrographs of composites made by centrifugal casting.
Figure 6:
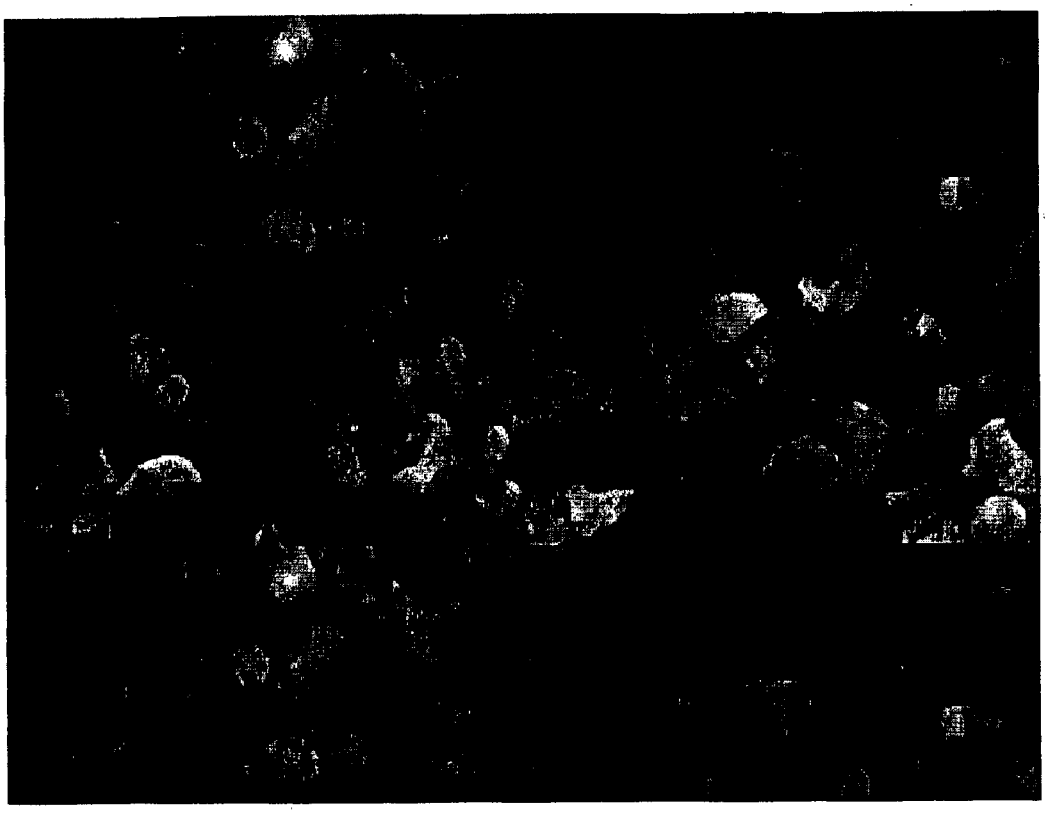
Figure 7:
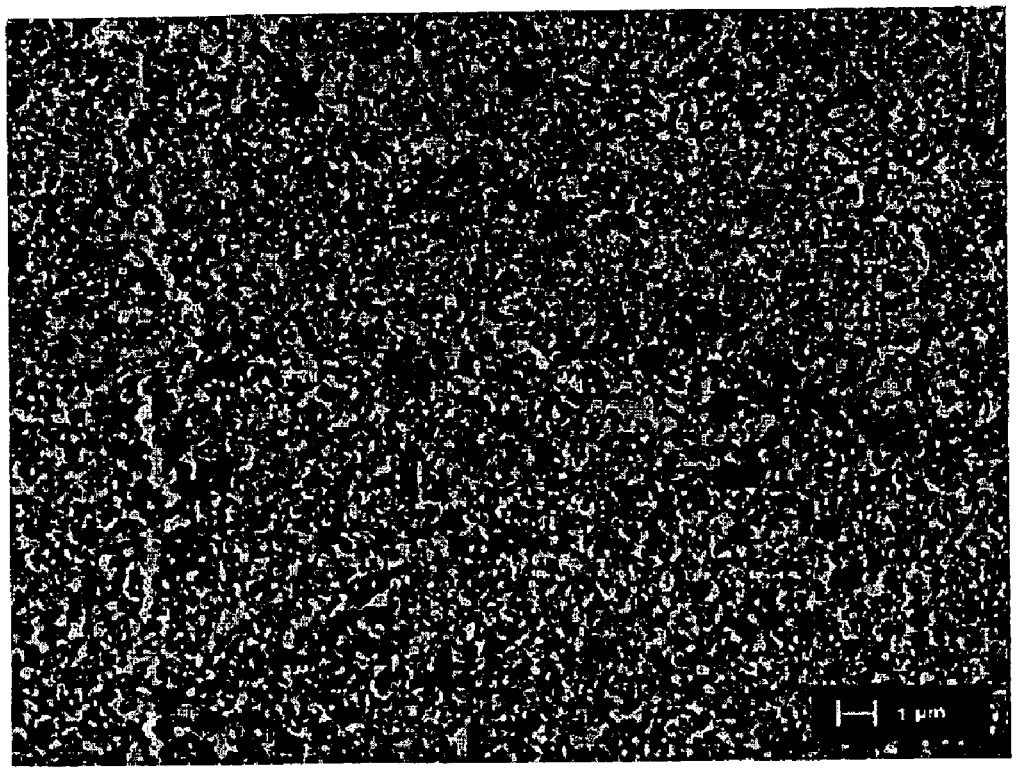

The system used a single cylindrical runner of the configuration shown in FIG. 3*c*, with a counterweight to balance rotation. Before infiltration, the preform is located 18 cm away from the axis of rotation, and molten metal fills the runner to a distance 2 cm away from the axis. The system was heated to about 250° C. and rotated at a speed of 2300 rpm, providing a centrifugal pressure at the preform of about 7 MPa (70 atm). During infiltration, the metal front moved about 1 cm (leaving 17 cm of molten metal outside the preform). The resulting composites were well infiltrated, as can be seen from the micrographs shown as FIGS. 5–7. FIG. 5 is a backscattered scanning electron microscope (SEM) micrograph of a composite having a particle size of about 1 μm. FIG. 6 is a higher-magnification SEM micrograph of the same composite. FIG. 7 is a backscattered SEM micrograph of a composite made with 0.3 μm particles.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A centrifugal casting system for casting a desired part, comprising:

an elongated mold cavity comprising a runner section and a mold section, the runner section having a central axis, and the mold section having a complementary shape to the desired part;

a porous preform comprising a reinforcing material, situated in the mold section of the mold cavity;

means for rotating the mold cavity about a rotation axis not parallel to the central axis;

a reservoir for introducing molten matrix material into the mold cavity at a predetermined head pressure, wherein the reservoir is arranged so as to maintain the head pressure at an approximately constant level during and after filling of the mold cavity and infiltration of the porous preform; and a valve positioned between the reservoir and the mold section of the mold cavity, the valve adapted to prevent introduction of molten matrix material into the mold section before a predetermined time or before a predetermined pressure is obtained.

2. The centrifugal casting system of claim 1, wherein the reservoir is located at the rotation axis of the mold cavity.

3. The centrifugal casting system of claim 1, wherein the reservoir is an extension of the runner section of the mold cavity and has a greater cross-sectional area than the runner section of the mold cavity.

4. The centrifugal casting system of claim 1, wherein the reservoir comprises rapid-filling means for introducing additional material into the mold cavity during rotation.

5. The centrifugal casting system of claim 1, wherein the valve can be opened by external control.

6. The centrifugal casting system of claim 1, wherein the valve is triggered to open by the rotation of the mold cavity.

7. The centrifugal casting system of claim 6, wherein the valve is a porous plug which has a characteristic infiltration pressure for the molten matrix material, and wherein molten matrix material can flow through the porous plug when the characteristic infiltration pressure is exceeded.

8. The centrifugal casting system of claim 1, wherein the molten material is a metal.

9. The centrifugal casting system of claim 8, wherein the molten material is selected from the group consisting of aluminum, zinc, magnesium, titanium, iron, copper, nickel, superalloys, and their alloys.

10. The centrifugal casting system of claim 1, wherein the molten material is a semisolid, a slurry, or a reactive fluid.

11. The centrifugal casting system of claim 1, wherein the porous preform comprises a ceramic material.

12. The centrifugal casting system of claim 11, wherein the porous preform comprises a material selected from the group consisting of carbon, silicon carbide, alumina, silica, titanium carbide, and titanium boride.

13. The centrifugal casting system of claim 1, further comprising a second elongated mold cavity comprising a runner section and a mold section, wherein the rotation means rotates both mold cavities about the same rotation axis.

14. The centrifugal casting system of claim 1, wherein the molten matrix material reacts with the porous preform as it enters the mold section.

15. A microcasting system for casting at least one micro-scale or submicron component, comprising:

an elongated mold cavity comprising a runner section and a mold section, the runner section having a central axis and the mold section comprising a micron-scale or submicron mold for the at least one micron-scale or submicron component;

means for rotating the mold cavity about a rotation axis not parallel to the central axis;

a reservoir for introducing molten matrix material into the mold cavity at a predetermined head pressure, wherein the reservoir is arranged so as to maintain the head pressure at an approximately constant level during and after filling of the mold cavity, including the micron-scale or submicron mold; and a valve positioned between the reservoir and the mold section of the mold cavity, the valve adapted to prevent introduction of molten matrix material into the mold section before a predetermined time or before a predetermined pressure is obtained.

16. The microcasting system of claim 15, wherein the valve can be opened by external control.

17. The microcasting system of claim 15, wherein the valve is triggered to open by the rotation of the mold cavity.

18. The microcasting system of claim 17, wherein the valve is a porous plug which has a characteristic infiltration pressure for the molten matrix material, and wherein molten matrix material can flow through the porous plug when the characteristic infiltration pressure is exceeded.

19. A method of forming a composite, comprising:

introducing a porous preform comprising a reinforcing material into a centrifugal caster, the caster comprising:

an elongated mold cavity comprising a runner section and a mold section, the runner section having a central axis;

a reservoir for introducing molten matrix material into the mold cavity, wherein the preform is introduced into the mold section of the mold cavity; and a valve positioned between the reservoir and the mold section of the mold cavity, the valve adapted to prevent introduction of molten matrix material into the mold section before a predetermined time or before a predetermined pressure is obtained;

introducing sufficient molten matrix material into the reservoir to infiltrate the preform and fill the mold cavity;

rotating the mold cavity about the rotation axis at a speed sufficient to accelerate the molten matrix material to create a pressure head in excess of the characteristic threshold infiltration pressure;

infiltrating the preform with molten matrix material, wherein the pressure head is maintained at an approximately constant level throughout infiltration; and separating any matrix material in the runner section of the mold cavity from the infiltrated preform.

20. The method of claim 19, wherein the valve is opened after rotation of the mold cavity commences.

21. The method of claim 19, further comprising heating the reservoir.

22. The method of claim 19, further comprising heating at least a portion of the mold cavity.

* * * * *